United States Patent [19]

Ho

[11] Patent Number: 4,828,072

[45] Date of Patent: May 9, 1989

[54] HIGH RISE BUILDING FIRE ESCAPE/FIRE FIGHTING AND BUILDING MAINTENANCE SYSTEM

[76] Inventor: I-Chung Ho, 6958 Grovespring Dr., Rancho Palos Verdes, Calif. 90274

[21] Appl. No.: 931,222

[22] Filed: Nov. 14, 1986

[51] Int. Cl.[4] ..... A62B 1/20

[52] U.S. Cl. ..... 182/9; 182/82

[58] Field of Search ..... 182/82, 235, 240, 71, 182/72, 191-193, 36-38, 9, 10, 189

[56] References Cited

U.S. PATENT DOCUMENTS

| | | | |
|---|---|---|---|
| 4,406,349 | 9/1983 | Vilchek | 182/82 X |
| 4,499,966 | 2/1985 | Milne et al. | 182/82 X |
| 4,629,032 | 12/1986 | Armstrong | 182/82 X |

*Primary Examiner*—Alvin C. Chin-Shue

[57] ABSTRACT

An emergency escape/fire fighting and building maintenance system including columns mounted to the exterior of a building for guiding either an escape slider or a fireman or maintenance lift. Each column has an inner and outer face which either assists in controlling the rate of descent of the escape slider or provides a means for allowing a fireman's lift or maintenance lift to climb the columns. The slider includes a harness and a body member which is engageable with and slidable down the column. The body member includes brake pad surfaces to provide an automatic braking system in the event the user is unable to maintain the desired escape posture and control his descending speed. Manual braking system is added to the alternate slider designs. The slider is intended to be used by able bodied persons since its descending speed is in part to be controlled by the user himself. After this system is placed into service, sliders for disabled persons and/or those physically not too fit persons may be developed at a later date.

2 Claims, 13 Drawing Sheets

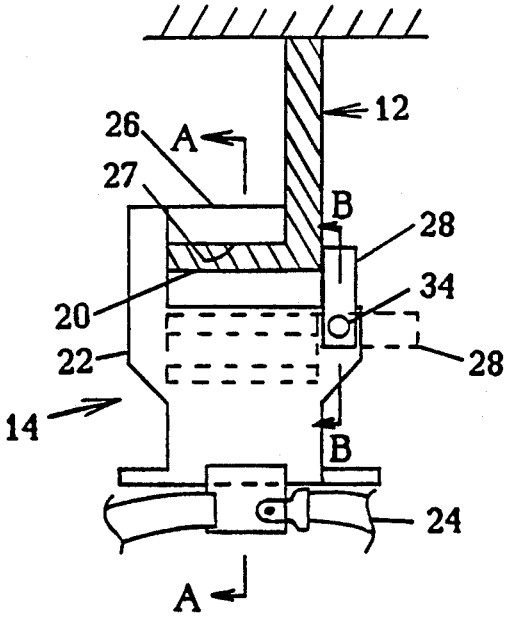
FIG. 3 - A
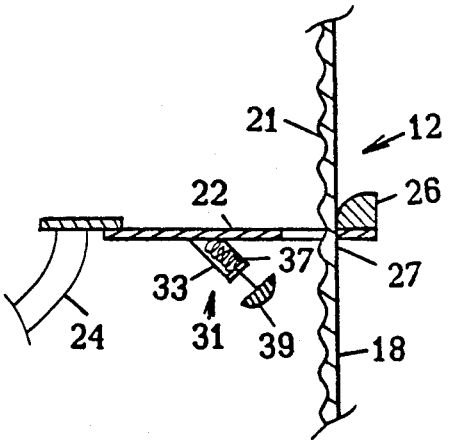
FIG. 3 - C
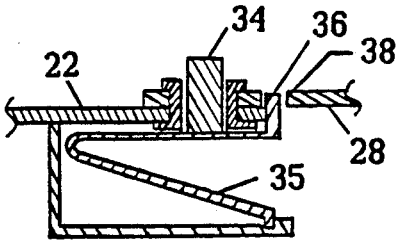
FIG. 3 - B
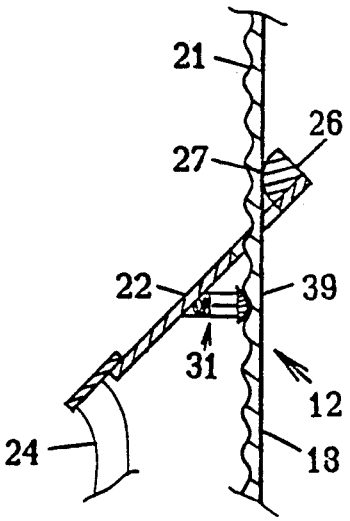
FIG. 3 - D

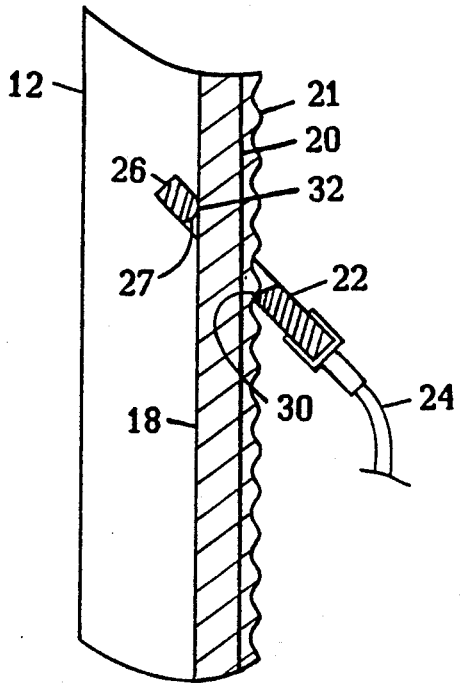
FIG. 4 - A
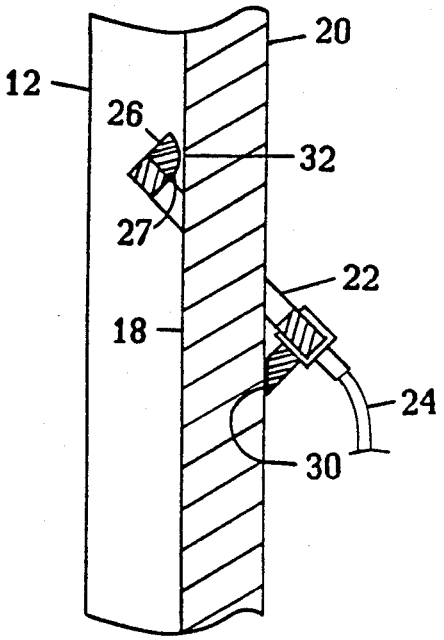
FIG. 4 - B

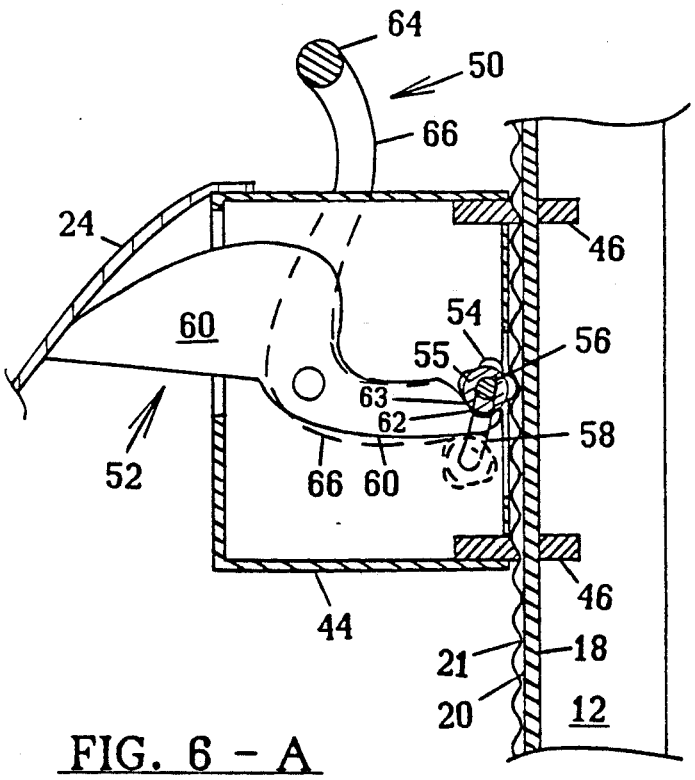
FIG. 6 - A
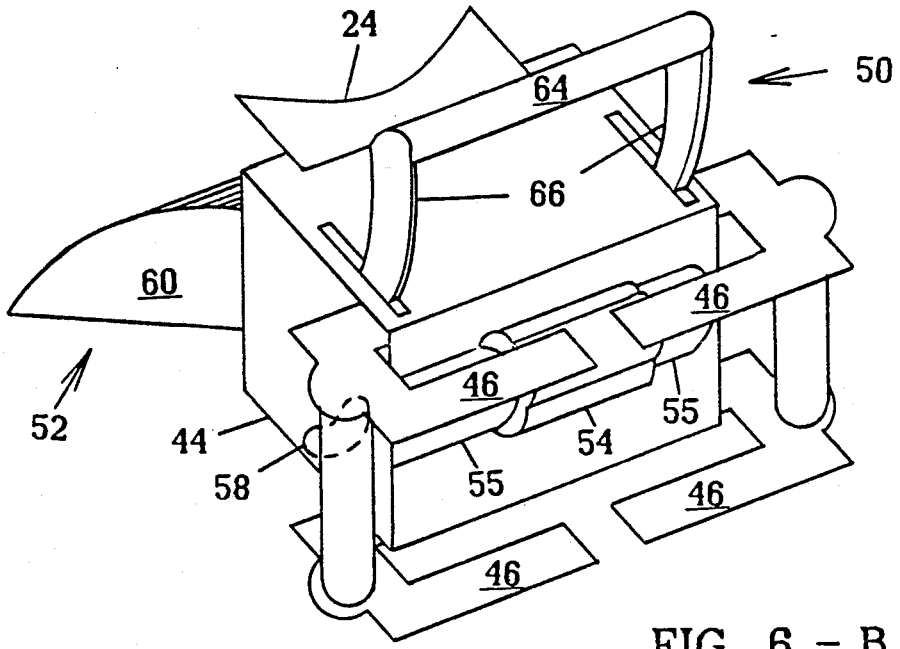
FIG. 6 - B

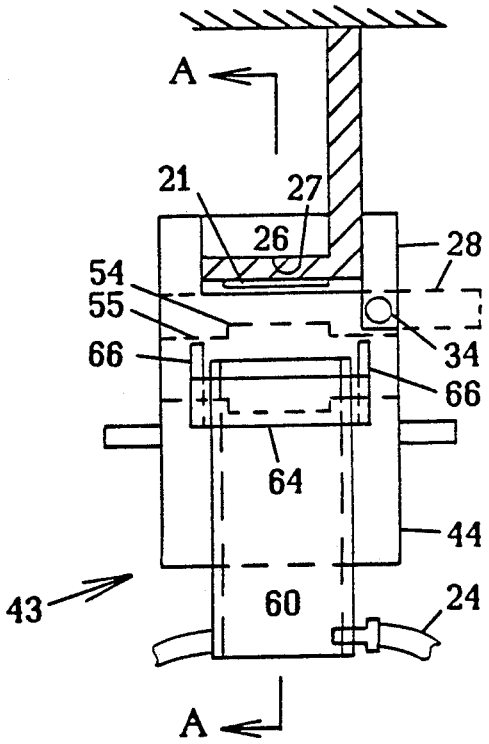
FIG. 7 -A
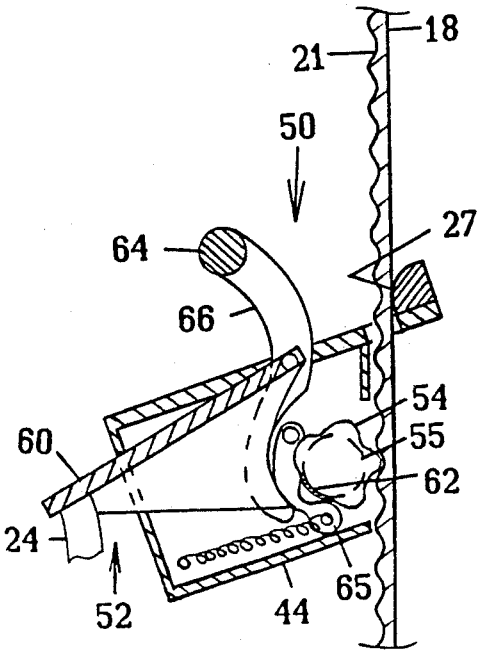
FIG. 7 - B
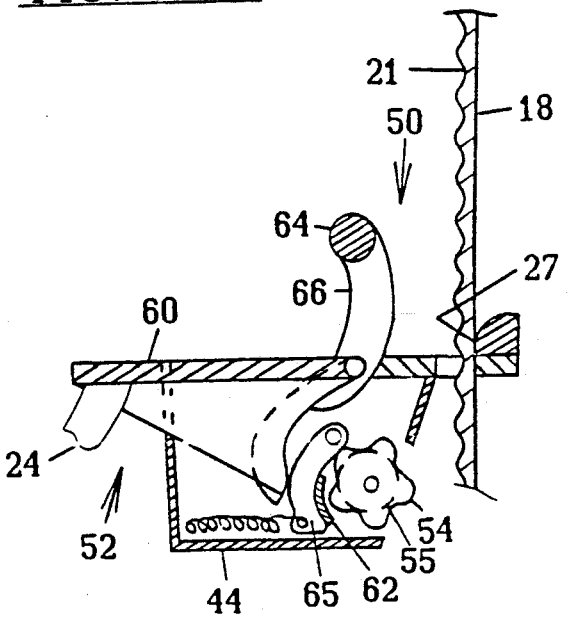
FIG. 7 - C

HIGH RISE BUILDING FIRE ESCAPE/FIRE FIGHTING AND BUILDING MAINTENANCE SYSTEM

BACKGROUND OF THE INVENTION

This invention relates in general to fire escape/fire fighting and building maintenance systems for use in connection with high rise buildings and the like, and in particular to an escape/rescue system including one or more upright columns on the outside walls of the high rise and an escape slider for each occupant of the building.

In the event of fire in a high rise building, whether it be a hotel, apartment or office building, conventional escape routes may often be unusable. Elevators can become disabled in times of fire and can become death traps due to a power failure. Staircases can be smoke filled and may be blocked preventing access to the ground. Traditional fire fighting rescue equipment such as hook and ladder trucks are not always available nor capable of reaching the upper floors of a high rise building. Thus there is a need for an accessible fire escape system which is simple, reliable and readily available at all times to all occupants of a building.

In order to provide some means of emergency exit for occupants of a high rise building which overcome the problems associated with the normal means of ingress and egress, many other emergency escape systems have been disclosed. U.S. Pat. No. 4,433,752 (Gunter) discloses a rescue device including a rescue cabin suspended by a cable and guided on a rail mounted on the side of the high rise. U.S. Pat. No. 4,485,891 (Friess) discloses an emergency escape system including a lowering device clamped to a vertical I-beam running the height of the building and an automatic descent speed controller using drums revolving in a viscous fluid enclosure.

U.S. Pat. No. 4,350,224 (Jochum et al) shows a rescue cabin with a transmission guide element engageable with a rail mounted to the high rise. A motor attached to the transmission element drives the cabin up and down the rail.

U.S. Pat. No. 4,121,689 (Bonvin) discloses an escape mechanism which includes an inertial escapement member for hindering rotation and for slowing the descent by gravity of the escape mechanism.

U.S. Pat. Nos. 4,406,349 (Vilcheck), 4,485,893 (Fontan); 4,499,966 (Milne et al) and 4,550,801 (Forrest) each describe an individual escape device from high rise buildings which include descent velocity control means.

All previous escape devices are either too costly or not very practical which are basic reasons for not being accepted by the public. This invention eliminates these drawbacks and can be implemented on most existing high rise buildings.

It is an object of the present invention to provide an emergency escape system which is readily accessible to a majority of occupants of a high rise building.

It is another object of the present invention to provide an emergency escape system which is economical, practical and can be easily carried about by the occupants of a high rise building.

It is another object of the present invention to provide a gravity operated emergency escape device having an automatically operated braking system in the event the user is unable to physically sustain a controlled descent.

It is another object of the present invention to provide an emergency escape system which requires no external power source for operation.

It is another object to provide a fire escape system which can be utilized by fire fighting and building maintenance equipment.

It is another object of this invention to provide a system which can be used to assist in the evacuation of a building as well as the protection and maintenance of the building.

SUMMARY OF THE INVENTION

The present invention is directed to an improved fire escape/fire fighting and building maintenance system. In accordance with the present invention, the high rise building fire escape/fire fighting and building maintenance system comprises a number of sliding columns outside of the building, the number of columns depending on the height and size of the building as well as the average number of occupants in the building. The column is generally vertically disposed between the building's roof to a point at or near the ground. The particularly cross-section of the column is not important as long as it includes two or more contact surfaces and a torque can be generated when a tilting force is applied on the column. The column further includes a gear track on a portion of its outer contact surface.

Associated with each particular cross-sectional design of the column is a compatible escape slider and lift. The slider, in its simplest form, comprises a body member engageable with the column and a harness or strap securely attached thereto. The body member further includes brake pads which come into contact with the sliding faces of the column when needed.

The lift, either used for fire fighting or building maintenance, includes a housing, a clamp and brake subassembly and a user platform. The housing includes the motor and clutch subassembly and the control panel. The lift is carried up or down the column by using the gear track on the outer face of the column as a means of providing the requisite traction. A drive belt, rotatable about drive wheels and driven by the motor, provide the force by which the lift moves up and down the column.

BRIEF DESCRIPTION OF THE DRAWINGS

FIGS. 3A–3D are perspective views of the escape slider of the present invention.

FIGS. 4A and 4B are cross-sectional views of the slider of FIG. 3 having alternative braking systems engageable with the column of FIG. *2a*.

FIGS. 6A and 6B are cross-sectional views of the alternative slider shown in FIG. 5.

FIGS. 7A–7C show a top plan view and a cross-sectional view of yet another alternative slider.

DETAILED DESCRIPTION OF THE PREFERRED EMBODIMENT

Figure 1:
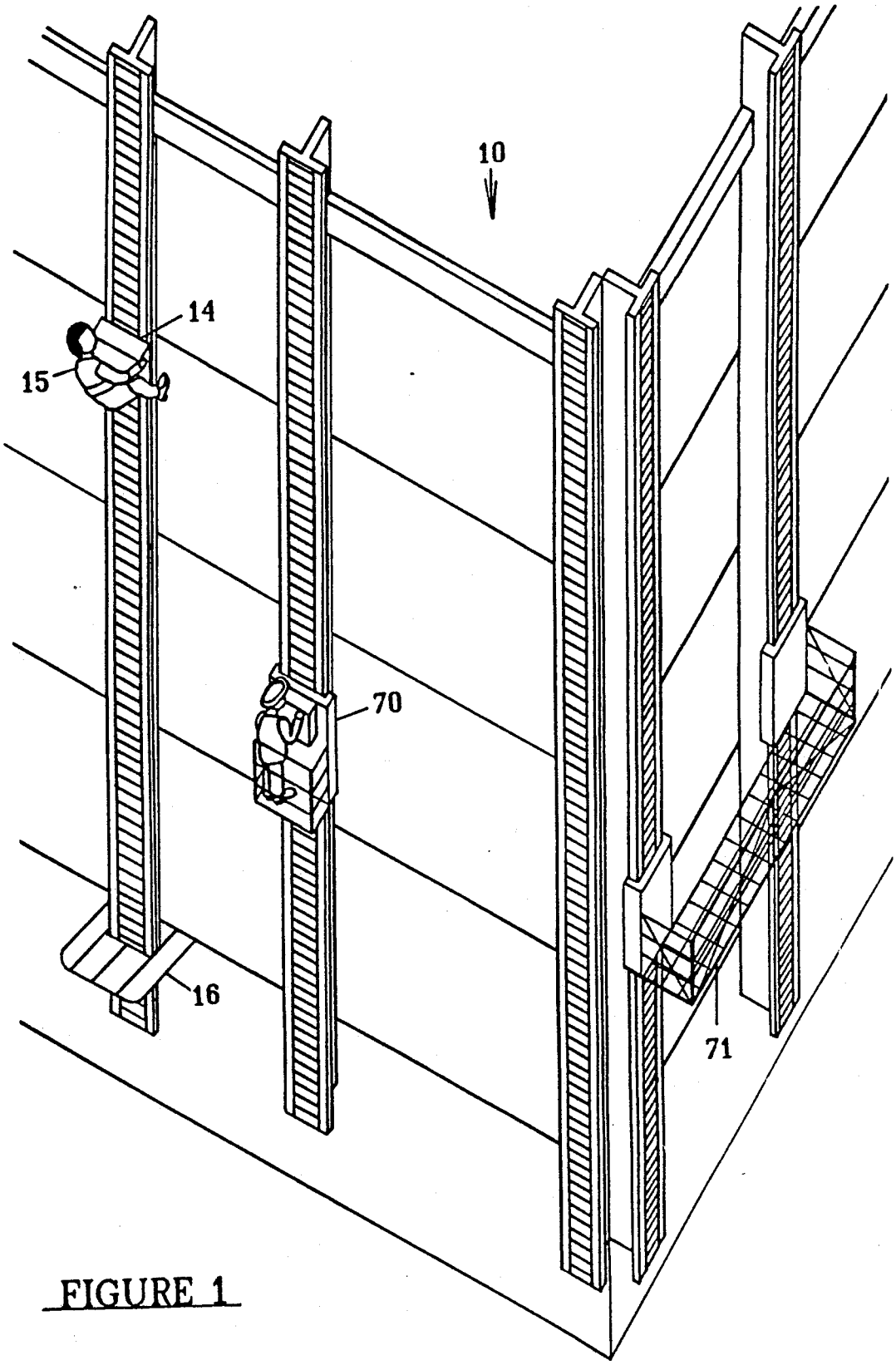
FIG. 1 is a perspective view of an emergency escape/fire fighting and building maintenance system according to the present invention.

Shown in FIG. 1 is the preferred embodiment of an emergency escape, fire fighting and building maintenance system 10. Emergency escape portion of system 10 comprises a column 12 and a slider 14. Column 12 extends from the roof of the high rise building down to near the ground surface of the building. Normally the columns 12 are straight but may be curved away from escape exits of lower floors for a specific purpose; i.e. to control the access of each column to a given escape zone to avoid overcrowding. Additionally, certain fixed or deployable landing platforms for access to the columns may be erected around the sliding columns 12 at the roof top and/or designated escape exits at each floor. Deflectors 16 which prevent unauthorized ascent of the building may also be added to the column near ground floor.

A sufficient number of sliders 14 can be stocked at each floor or exit platform and/or can be assigned to each able bodied occupant 15 of the building. In the event of a fire or other natural catastrophe, occupants can quickly buckle themselves to the slider 14, engage the slider with the sliding column 12 from the roof or from a designated escape window or platform and rapidly descend to safety.

Figure 2:
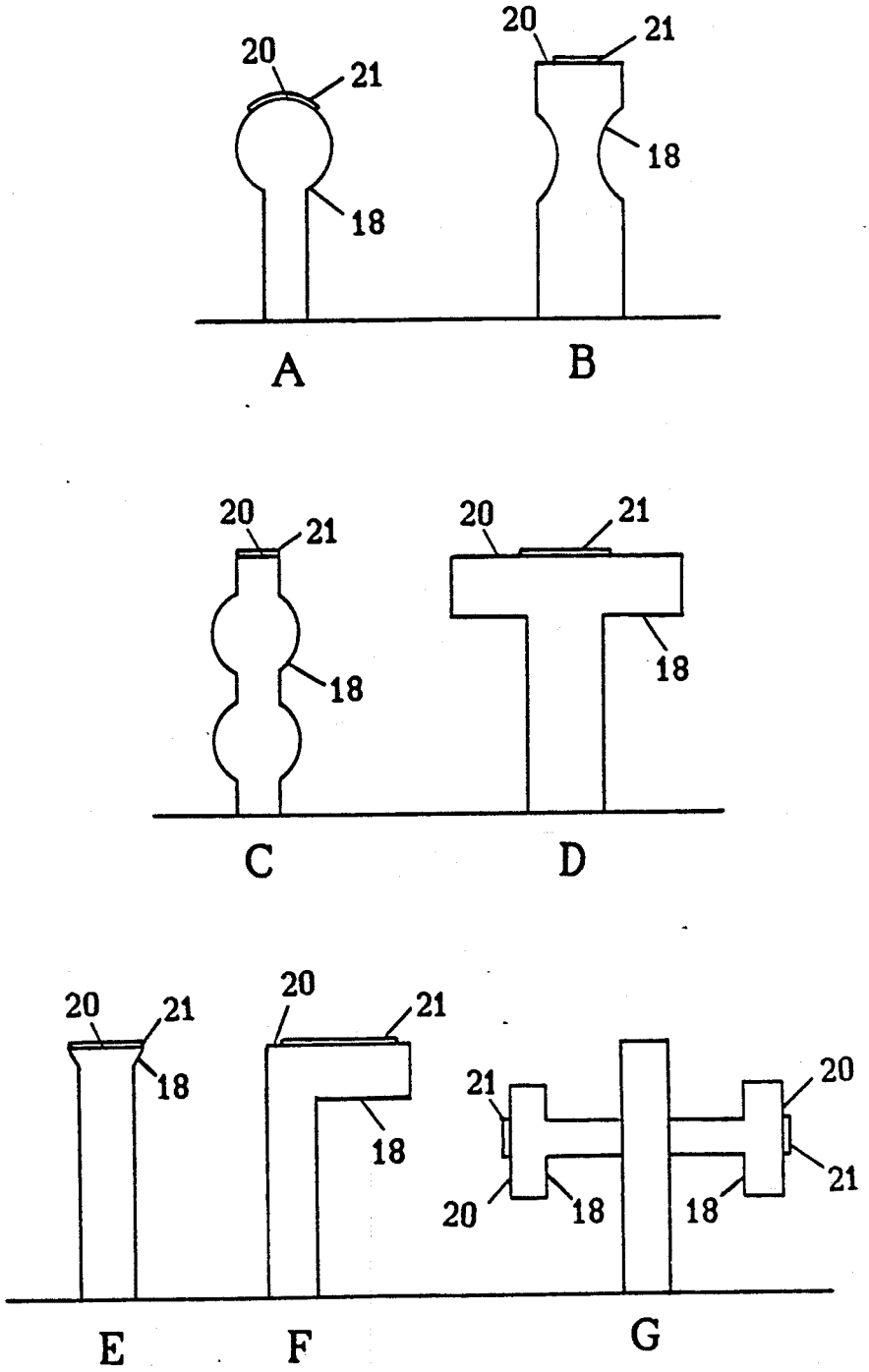
FIG. 2 is a cross-sectional view of several sample column designs which can be used in association with the present invention.

As shown in FIG. 2, the cross-section of the sliding column 12 can be any suitable shape as long as it includes an inner and outer face, 18 and 20 respectively. Eventually, a standard cross-sectional shape and size will be selected for uniformity so that a particular slider 14 will be useable in any building.

Shown in FIG. 3-A is slider 14. Slider 14 includes a body member 22 and harness 24. It is important that body member 22 be shaped to be complimentary to and engageable with the inner face of the column. Hence, when used in association with column 12 having a L-shaped cross-section as shown in FIG. 2F, the slider 14 is shaped as shown. Body member 22 includes an arm 26 having a surface 27 engageable with the inner face of the L-shaped column and slidable down the column. Body member 22 also has a locking bar 28 to prevent disengagement of the slider 14 from the column 12. Bar 28 can be retracted or swung away into the disengagement position for engage or disengage the body member from column 12. FIG. 3-A presents the swing away method and is activated by pressing release button 34 which in turn compresses spring 35 and releases the locking pin 36 (see FIG. 3-B). User 15 only need to swing the locking bar 28 forward toward the engaged position until the safety lock pin 36 springs up and locks in the lock hole 38 of bar 28. In this manner, the column 12 is captured within the slider 14.

Harness 24 is securely fastened to body member 22 and is shown as a single strap in FIGS. 3–7, but can be any particular design which adequately allows the user 15 to exert a force away from the building. While this emergency escape device does rely to a great extent on the ability of the user to maintain a controlled descent rate, there is a braking system which is built into the design of the column 12 and slider 14.

FIG. 3-C and 3-D show the emergency escape slider of FIG. 3-A in the sliding and braking mode. If the user lost his/her footing and is unable to maintain control, the user 15 will fall against the column 12. If this happens, the harness 24, due to the weight of the user 15, will pull the body member 22 downward and creating a torque against the column 12, thus causing spring-loaded brake 31 into contact with the column 12. Brake 31 includes a generally cylindrical housing 33 enclosing a helical spring 37 and a rounded braking surface 39. FIG. 4 discloses alternative braking systems of slider 22 wherein inner bottom section 30 of the body comes into contact with the outer face 20 of columns 12 and the upper inner portion 32 of the arm 26 contacts the inner face 18 of the column 12. Each of these four surfaces; 18, 20, 30 and 32; can include material which will enhance the frictional forces. The frictional forces are large enough to slow the descent of the user 15, though it is not necessarily designed to stop the descent altogther.

In order to control the descent of the user, a positive speed control can be employed. The outer face 20 of the column 12 can be shaped to include teeth or a wavy surface 21, see FIG. 3-C, 3-D and 4A. One advantage of having a teeth or wavy surfaced column is that it becomes possible to move up the column by means of a lift such as a fireman's rescue lift 70 or a maintenance lift 71 as will be described later; see FIG. 1.

Figure 5:
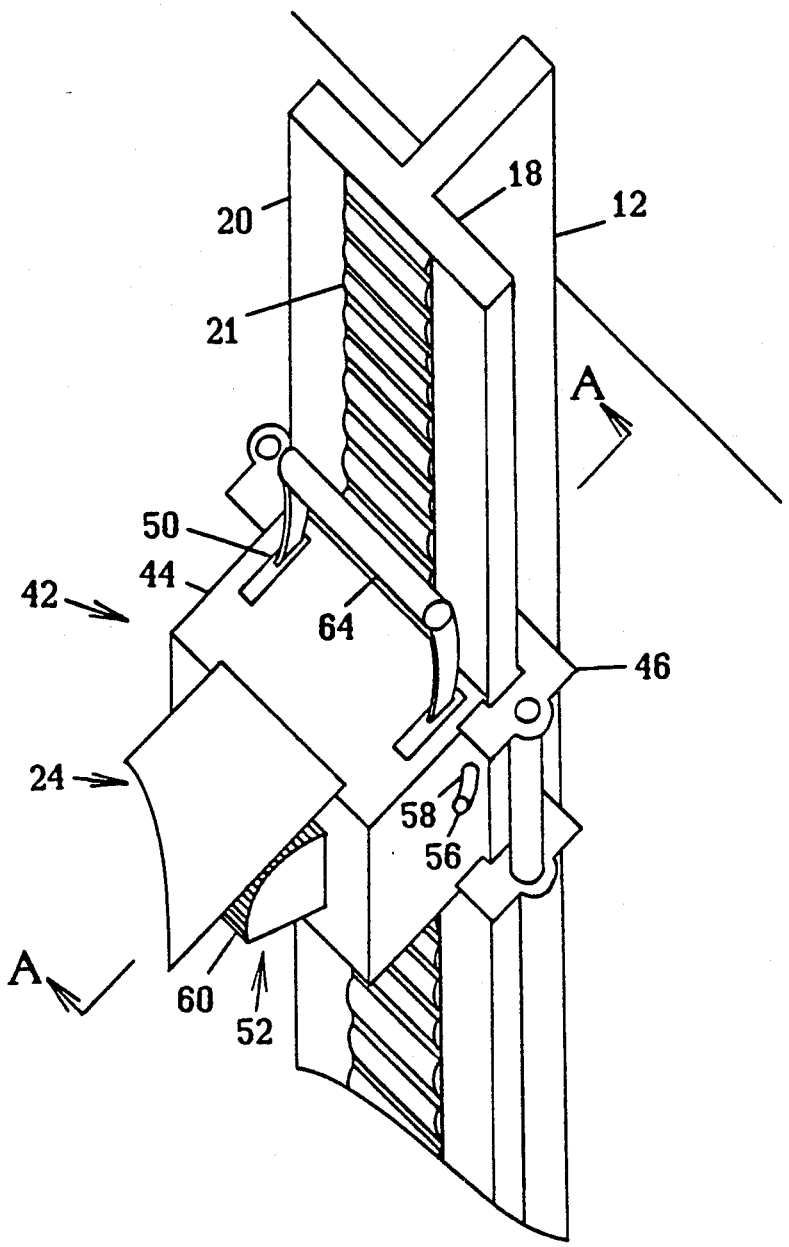
FIG. 5 is a plan view of an alternative slider according to the present invention.

FIGS. 5 and 6 disclose an alternative slider 42 including a dual braking system, which is shown utilizing a T-shaped column 12. With minor changes to its guide members 46, slider 42 can be used with any column 12 having a gear-toothed or wavy track 21 on its outer face 20. Alternative slider 42 comprises two guide members 46 spaced apart and rigidly connected to housing 44. Guide members 46 defining identical cavities therein which slide over the T-shaped column 12. One or both of the guide members 46 can be extendable from housing 44 in order to engage the slider 42 to the column 12. Thereafter, it is pushed back into the housing 44 and secured in the proper locking position. In this manner the slider 42 (FIG. 5) is in contact with both faces of column 12 and slides thereon. A harness 24 is securely attached to housing 44 and can be of the type used in the preferred embodiment.

Referring to FIG. 6, slider 42 includes manual and automatic descending speed brakes or controls 50 and 52 respectively. A gear toothed/way surfaced roller 54 sized to be engageable with the column's gear track 21 is rotatably attached to the housing 44. The roller 54 has a floating shaft 56, capable of moving up and down within a curved slot 58 in the housing 44. On the same shaft 56, there are also two brake cylinders 55 on both sides of the roller 54. The automatic descending speed brake 52 comprises a pivotably mounted lever 60 which extends out of housing toward the user 15. It is important that the end of the lever 60 extending out of the housing 44 is positioned below the connection of the harness 24 to housing 44. In the event the user 15 is unable to keep their distance the column 12 using their feet and lose their ability to control the descending speed, the weight of their body will result in the harness 24 being pulled down, thus pushing automatic brake lever 60 downard and in turn pushing the brake pad 62 mounted on the inner ends of the lever 60 against the brake cylinders 55 and push the floating shaft 56 upward. As the roller 54 is pushed upward within slot 58, the gear teeth or wavy surface of the roller 54 and the gear track 21 of column 12 gradually come into contact, thus increasing the contact pressure between the two. This increase pressure will decrease the rotational speed of the roller/shaft and will slow down the rate of descent. When harness 24 pushed down further against pivoting level 60, and the floating shaft 56 reached its top end of slot 58, the brake pads 62 start to brake against brake cylinder 55. The roller speed and the descent speed are further reduced to an acceptable rate (may of may not come to a complete stop) until the user can regain their control again.

The manual speed brake or control 50 includes a pivotably mounted handle 64 located outside of housing 44 and including two handle arms 66. Arms 66 also has a brake pad 63 on the other end of the handle arms 66. If the user wishes to slow their rate of descent, they pull the handle 64 toward themself, thereby the brake pad 63 pushing the roller 54 upward and closer to the guiding column 12 as explained above. In this manner, the user 15 can further control their rate of descent on top of normally controlled by their feet.

In order to provide a gradually increasing rate of friction, the braking pads 62 and the top of slot 58 can be covered with a material to assist in increasing the frictional forces between the roller braking surfaces and those surfaces which come into contact therewith.

FIG. 7 discloses yet another alternative slider 43 which operates somewhat in between the sliders 14 and 42 shown in FIGS. 3 and 5. As shown in FIG. 7-C when the user is able to control their descending speed using their feet, they are sliding down the column 12 with the sliding surface 27 against the inner surface 18 of column 12 and operated in the same manner as slider 14 shown in FIG. 3-C. However, if the user is unable to control their footing and keep their sliding position, their body weight will fall down and pull the slider 43 downward and cuasing the slider body 44 to tilt into FIG. 7-B position. This will cause the gear shaped roller 54 (not a floating shaft) to engage with the wavy shaped 21 on column 12. The pressure from the tilting torque will cause the roller 54 to slow down the descending speed. This slider 43 includes similar manual 50 and automatic 52 brakes as slider 42 described in FIG. 5 and 6. FIG. 7 does shown a separate pivotable pair of brake shoes 65 with brake pads 62. Brake shoes 65 are pushed against brake cylinder 55 by either automatic brake level 60 or by manual brake handle arms 66.

Either of these types of sliders can also be used as entertainment centers for children in playgrounds. Columns can be mounted against walls which allow participants to use the sliders over a relatively short distance. This use as a toy will provide invaluable experience using a slider as an escape means from a high rise building during an emergency.

Shown in FIGS. 8–12 is a fire fighting/rescue lift to which is used in the present system 10. As shown, a single lift 70 can be used by fire fighting personnel to carry equipment up the side of the building to fight fire or as a rescue lift to bring occupants to the ground. Furthermore, two or more such lifts can be used side-by-side as a maintenance lift 71, see FIG. 1, as will be explained below.

Figure 8:
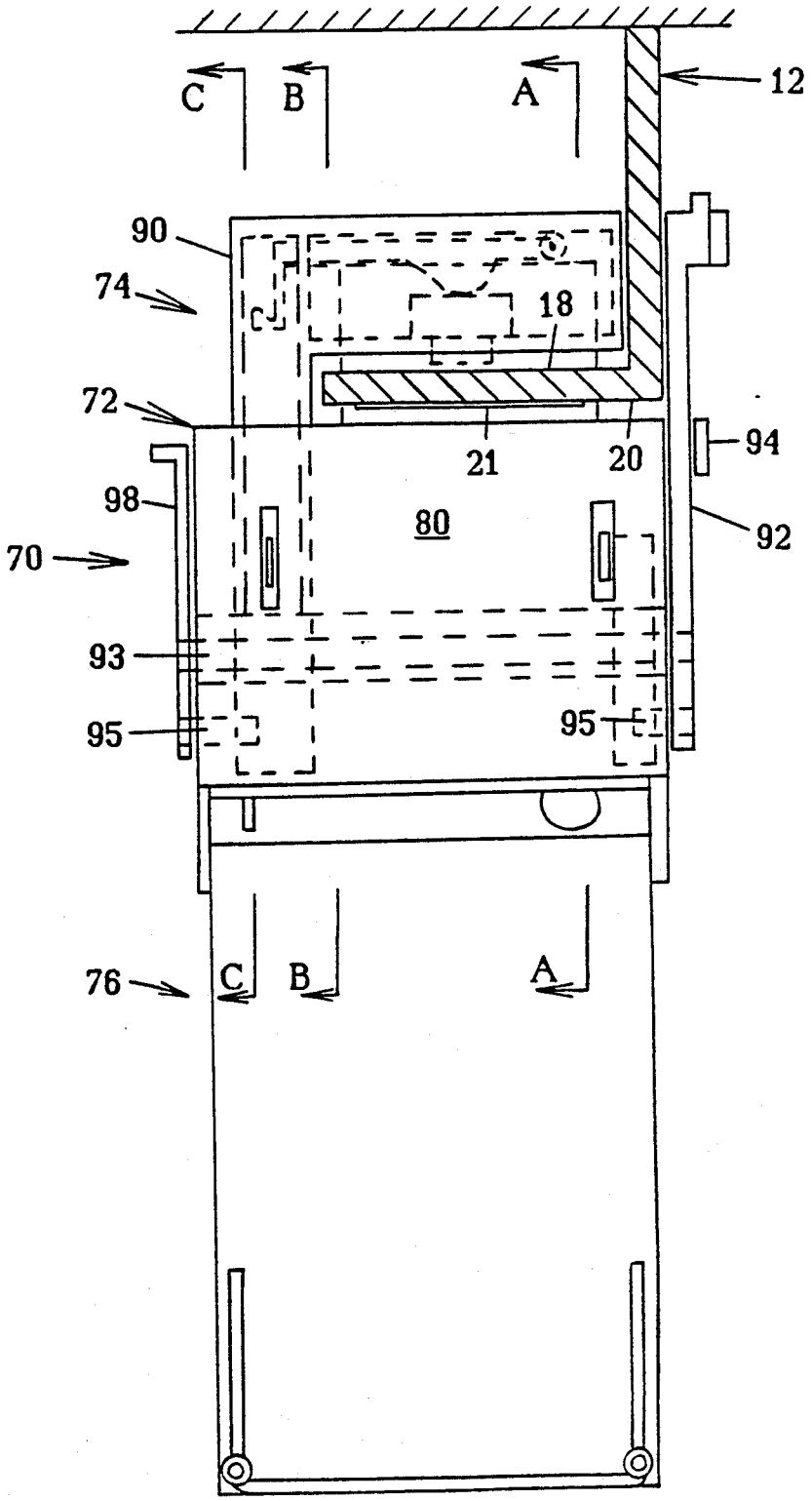
FIG. 8 is a top, plan view of the fire fighting/rescue lift of the present invention.

As shown in FIG. 8, the column 12 has been shown in cross-section as L-shaped. Column 12 includes an outer face 20 having a gear track 21 thereon. The lift 70 comprises a housing 72, a clamp and brake sub-assembly generally designated as 74 and a user platform 76. The main housing 72 encloses a drive sub-assembly 78 (FIG. 10), a control panel 80, a drive chain 82, drive belt 84, drive wheels 86 and guide wheels 89.

The clamp portion of the clamp and brake subassembly 74 includes clamping arm 90, locking bars 92 and clamping levers 98. Locking bars 92 and clamping levers 98 are pivotal about shaft 93 such that it is swung upward in the direction of the arrow in FIG. 9. Clamping arm 90 is generally L-shaped, when used with a column as shown in the drawings, and includes a block member 99 attached to the housing end of the arm. In this manner the lift 70 can be slid onto the column 12. Locking bars 92 and clamping levers 98 are then lowered into a generally horizontal position relative to the housing 72. Flange members 94 are attached to the housing to receive the locking bars 92 and preventing the housing from becoming disengaged from the column 12.

Figure 12:
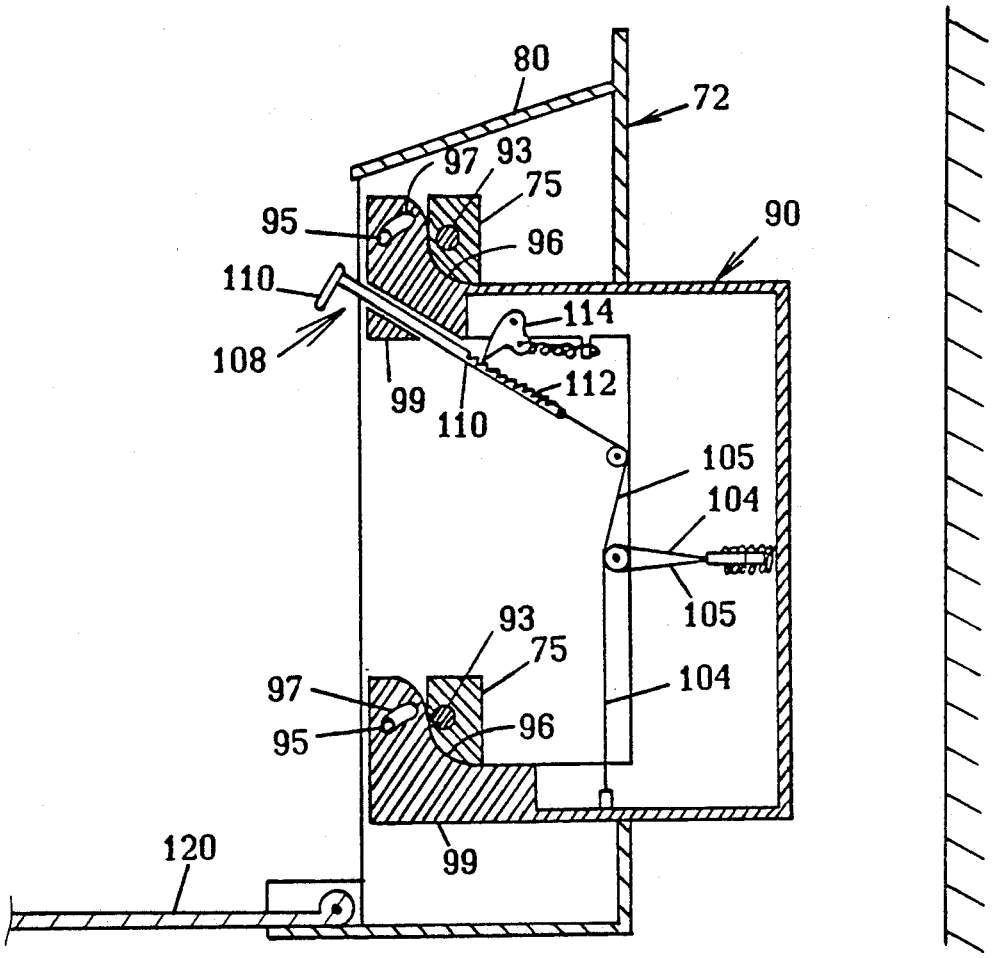
FIG. 12 is a cross-sectional view of the lift taken along line C—C of FIG. 8.

The lowering of locking bars 92 and clamping levers 98 also draws clamping arm 90 closer to the housing 72 by using a tightening mechanism (best seen in FIG. 12). Locking bars 92 and clamping levers 98 (FIG. 8, pivotable about shaft 93, can be pushed downward such that clamping pins 95, which are an integral part of the locking bars and the clamping levers, ride in slots 73 in housing 72 and slots 97 (FIG. 12) formed in block member 99 which is integral to clamping arm 90. Attached to housing 72 are guiding blocks 75 which acts to force the clamping block members 99 to move upward and left along the curved guiding surfaces 96 as seen in FIG. 12, thereby tighten the clamping of column 12 between the drive belt 84 and rollers 100 on clamping arm 90.

Figure 10:
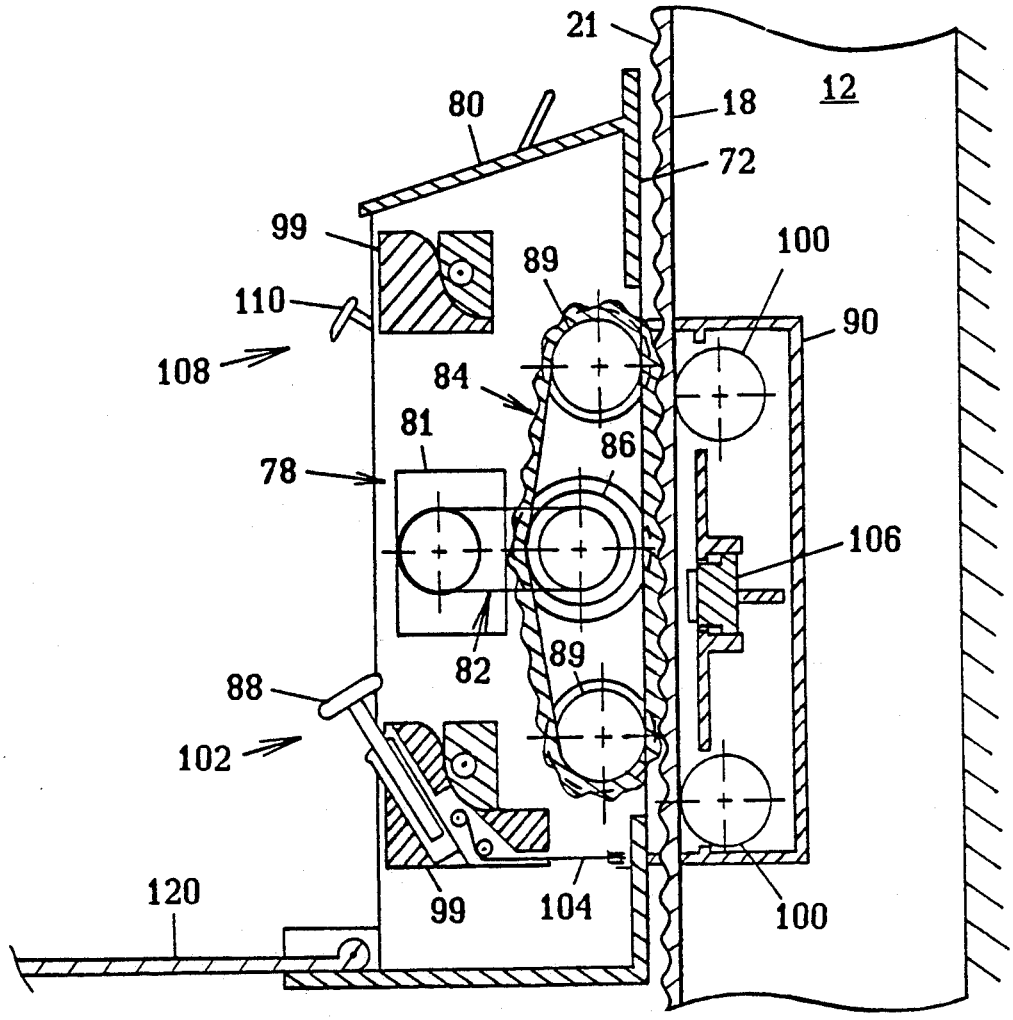
FIG. 10 is a cross-sectional view of the lift taken along line A—A of FIG. 8.

FIG. 10 details the drive mechanism of the present invention. Specifically, a motor 81, either electrical or gas driven, having a crankshaft output drives the drive chain 82 which in turn drives the drive wheel 86. Rotatable around the drive wheel 86 and the guide wheels 89 is the drive belt 84. Belt 84 includes an outer surface which is configured to be complimentary with the gear track 21 on the column 12. A wavy gear track 21 has been shown by way of example.

Figure 11:
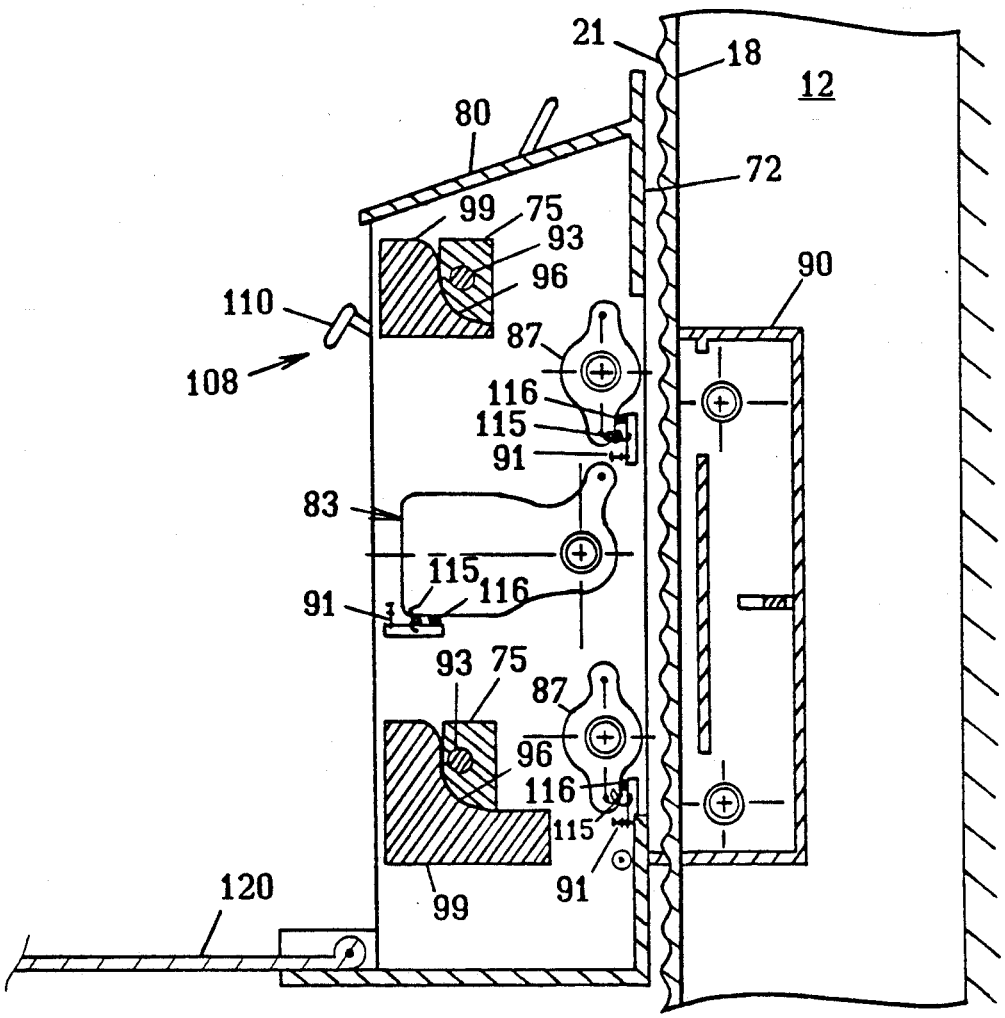
FIG. 11 is a cross-sectional view of the lift taken along line B—B of FIG. 8.

In addition, shown in FIG. 11 are motor and drive wheel mounts 83 and guide wheels mounts 87. Each wheel mount is resilient mounted with spring load 115 and bumper 116 and has an adjustment screw 91 in order to take up any slack in the drive mechanism. As described above, the damping or tightening feature of the resilient mount is important to ensure the proper contact between the drive belt 84 and gear track 21. Also, clamping arm 90 preferably includes rollers 100 (FIG. 10) to provide a rolling surface area between which the column is clamped. In this manner the lift can be powered up or down the column.

Also included in the lift is a braking system to either slow the velocity of the lift or stop it altogether. Specifically, a service brake 102 is connected via cables 104 to a brake shoe 106 located in the clamping arm 90. When the operator steps on the pedal 88 of service brake 102 the brake shoe 106 comes into contact with the inner face 18 of column 12, thereby slowing lift 70 down. In addition, the lift 70 includes a hand brake 108. As shown the hand brake 108 includes a handle and rod 110 having notches 112 at one end thereof. A spring loaded ratchet member 114 prevents the release of rod and disengagement of the brake once the handle 110 is pulled. The hand brake 108 is released by turning the hand brake rod 110 such that the ratchet member 114 is no longer exposed to the notches 112, thereby releasing the brake. The rod 110 is also connected via cables 105 to the brake shoe 106 located in the clamping arm 90. Not shown in the drawing, additional safety brake system may also be added to lock up the drive wheel 86 and/or the drive belt 84.

Figure 9:
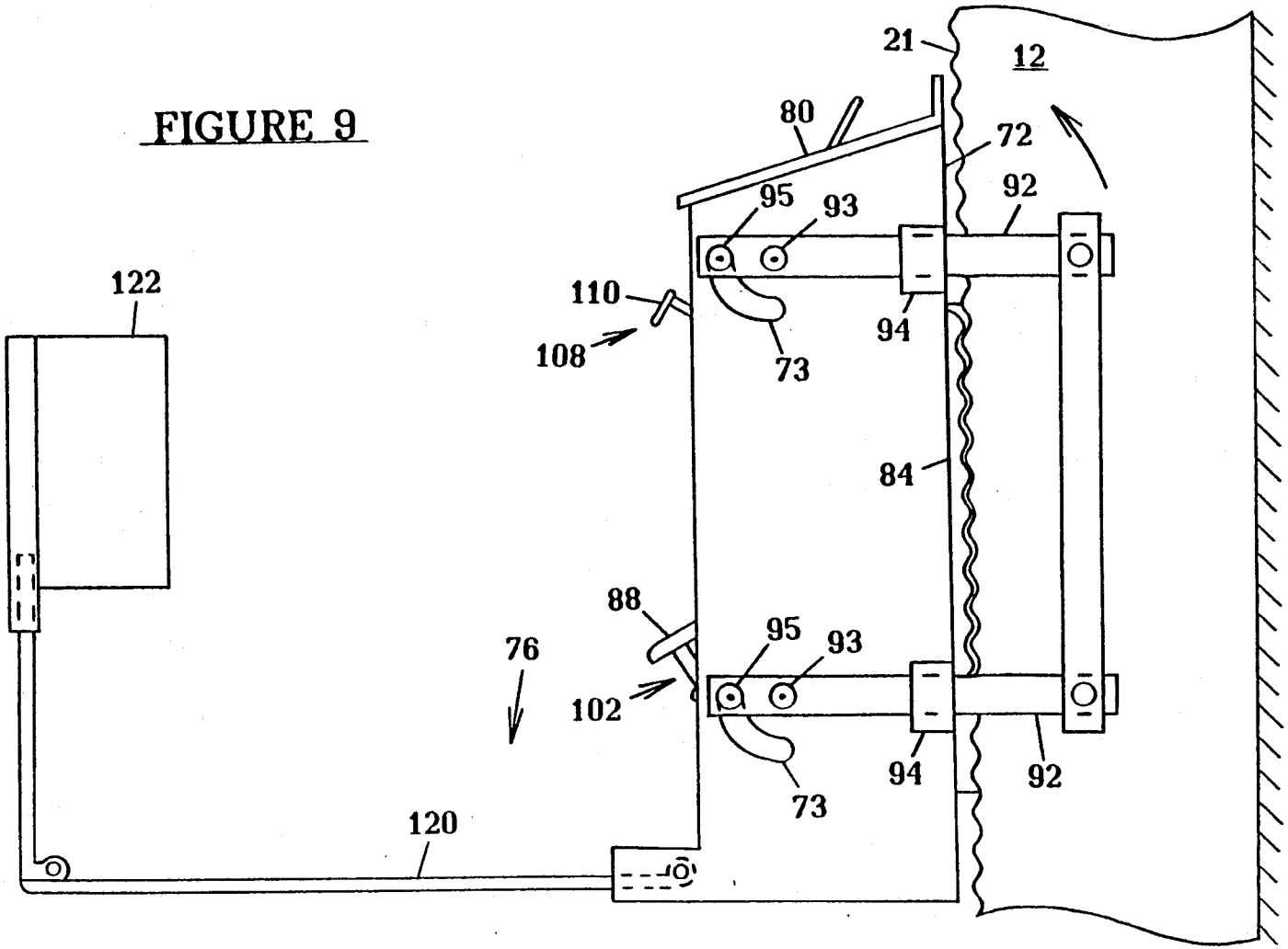
FIG. 9 is a side, plan view of the lift of FIG. 8.

User platform 76 can take a variety of forms but as shown in FIG. 9 includes a floor 120 and a guard railing and support 122. Both are pivotably mounted to the housing so that the lift 70 can be folded up for easy transportation.

When two or more lifts 70 are to be used as a maintenance lift 71 (see FIG. 1) a catwalk can be extended between any two lifts. When used in this manner, the lifts 70 need to be operated in unison, thereby a synchronized control device operatable from either one of the lift is to be used.

While the present invention has been described with respect to exemplary embodiments thereof, it should be understood that various changes and modifications to the preferred embodiments described above will be apparent to those skilled in the art without departing from the scope of the present invention.

Having described the invention with sufficient clarity, I claim:

1. An emergency fire escape apparatus used in associated with guide columns on the wall of a building, each guide column having a cross-section defining inner and outer faces, said outer face including a gear track; said device comprising:

at least one clamping arm defining a cavity such that said column is slidable between said clamping arm and said housing;

a lockable, releasable clamping arm;

means for securing said clamping arm such that said column is captured between said clamping arm and said housing and said apparatus is slidable down said column;

a housing securely attached to said means for guiding;

a harness securely attached to said housing;

a floating shaft having a gear-toothed roller portion and breaking surfaces on each side thereof, shaft ends movable within a slot formed within said housing;

a hand brake including a pivotable handle having levers attached thereto such that when pulled by said user, the levers come into contact with the breaking surfaces of said shaft forcing said shaft to move upward within said slot in the housing; and an automatic breaking means for reducing the rate of descent of the user.

2. The apparatus of claim 1 wherein said automatic braking means comprises:

a pivotal automatic brake lever having one end extending out of said housing and the other end positioned adjacent said floating shaft, and harness attached to said housing above said lever end extending out of said housing.

* * * * *